US007422506B2

(12) United States Patent
Lund et al.

(10) Patent No.: US 7,422,506 B2
(45) Date of Patent: Sep. 9, 2008

(54) CARTWHEELING CHARACTER

(75) Inventors: Bruce D. Lund, River Forest, IL (US); Michael D. Starrick, Maywood, IL (US); Krishnan Srirangam, Chicago, IL (US)

(73) Assignee: Lund & Company Invention LLC, River Forest, IL (US)

( * ) Notice: Subject to any disclaimer, the term of this patent is extended or adjusted under 35 U.S.C. 154(b) by 358 days.

(21) Appl. No.: 11/186,323

(22) Filed: Jul. 21, 2005

(65) Prior Publication Data

US 2007/0021030 A1 Jan. 25, 2007

(51) Int. Cl.
*A63H 11/08* (2006.01)
*A63H 11/00* (2006.01)
*B65D 25/54* (2006.01)

(52) U.S. Cl. ..... 446/324; 446/353; 206/775

(58) Field of Classification Search ..... 446/236, 446/268, 324, 308, 322, 325, 326, 311, 312, 446/376, 383, 330, 353; 206/756, 759, 775–783, 206/457

See application file for complete search history.

(56) References Cited

U.S. PATENT DOCUMENTS

| | | | | | |
|---|---|---|---|---|---|
| 895,186 | A * | 8/1908 | Killman | 446/324 |
| 2,021,588 | A * | 11/1935 | Baker | 446/324 |
| 2,389,365 | A * | 11/1945 | Whitaker | 446/325 |
| 3,500,577 | A * | 3/1970 | Bart | 446/324 |
| 3,728,815 | A * | 4/1973 | Tomiyama | 446/291 |
| 4,723,932 | A * | 2/1988 | Kelley et al. | 446/330 |
| 5,718,335 | A * | 2/1998 | Boudreaux | 206/461 |
| 5,759,082 | A * | 6/1998 | Kujawski et al. | 446/139 |
| 6,273,779 | B1 * | 8/2001 | Boulaire | 446/169 |
| 6,319,087 | B1 * | 11/2001 | Ferrigno | 446/297 |
| 6,672,935 | B1 * | 1/2004 | Lund et al. | 446/330 |
| 2005/0218036 | A1 * | 10/2005 | Ahn | 206/781 |

* cited by examiner

*Primary Examiner*—Gene Kim
*Assistant Examiner*—Alyssa M Hylinski
(74) *Attorney, Agent, or Firm*—Much Shelist

(57) ABSTRACT

A cartwheeling toy including an upper assembly including a torso with rigid arms and hands extending therefrom. A lower assembly including legs and a motor means for moving the assembles relative to each other to move the toy into a head-stand and then return it to its upright position or cartwheel the toy as desired.

15 Claims, 8 Drawing Sheets

108
18

22
100
20
20
22 A
102
19
19
48
44
45
54
52
68
66
104
42
46
82
30A
56
80
76
72
30
32A
32
58
74
60
72
62
64
70
36
40
34
38
39
41
39
43
41
43

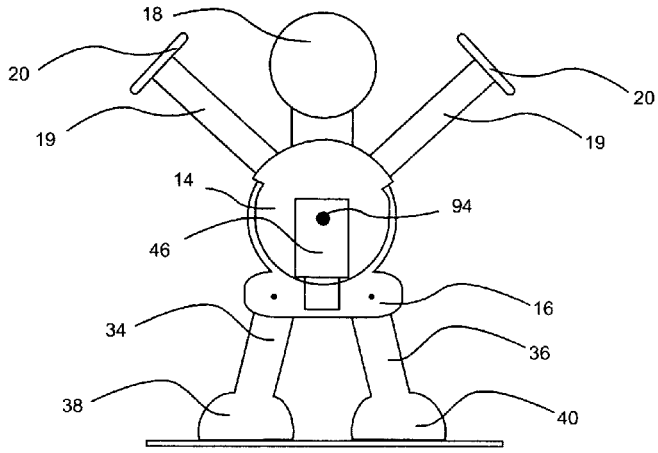
Fig. 6
Fig. 7.A
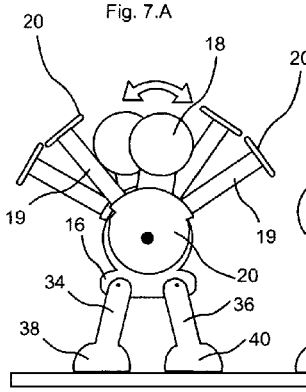
Fig. 7.B
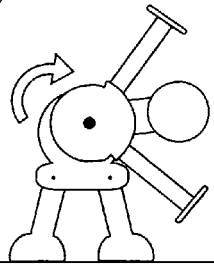
Fig. 7.C
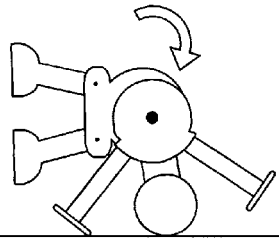
Fig. 7.D
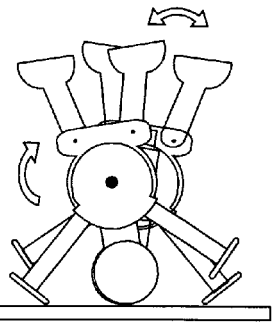
Fig. 7.E
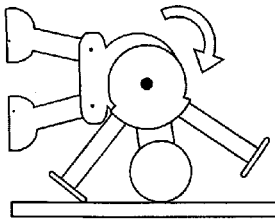
Fig. 7.F
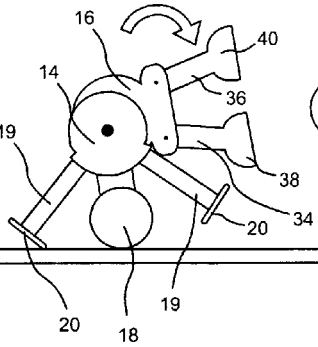
Fig. 7.G
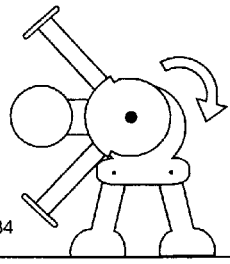
Fig. 7.H
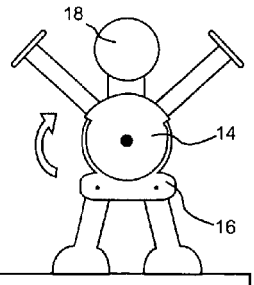

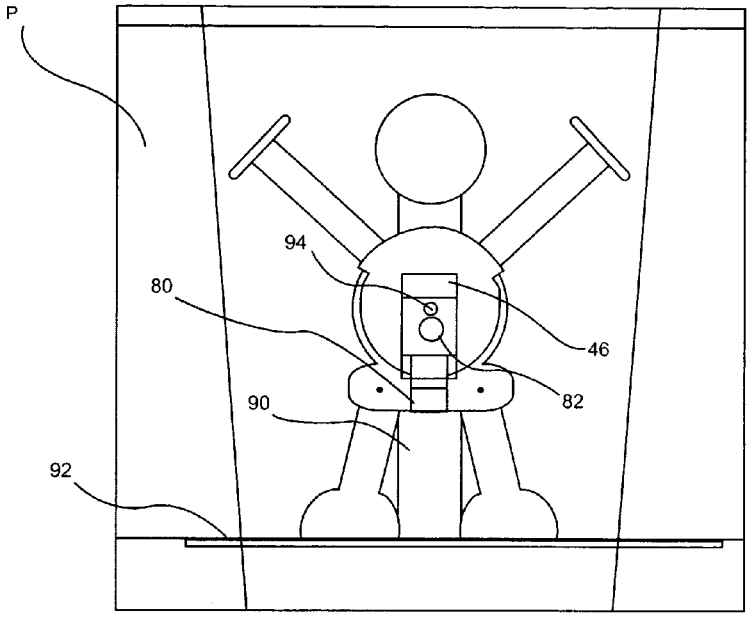
Fig. 8
Fig. 9.A
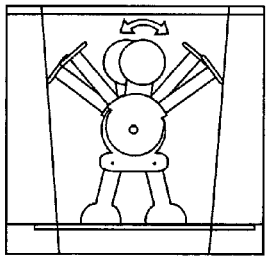
Fig. 9.B
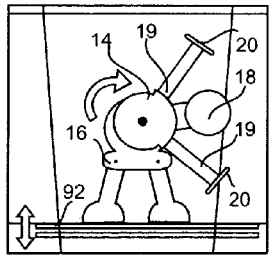
Fig. 9.C
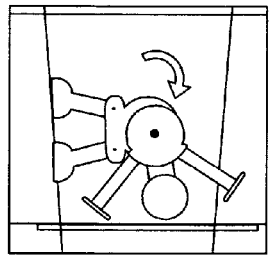
Fig. 9.D
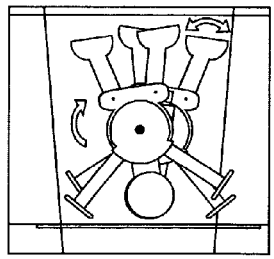
Fig. 9.E
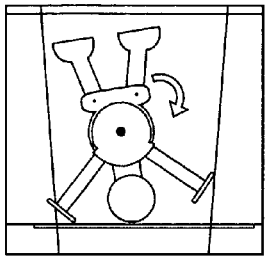
Fig. 9.F
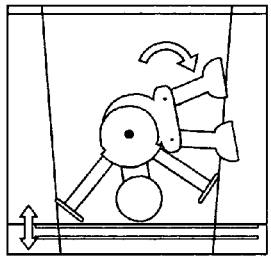
Fig. 9.G
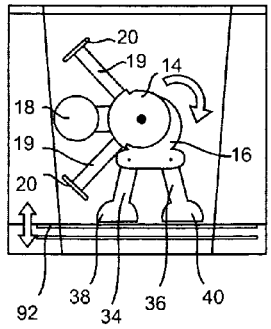
Fig. 9.H
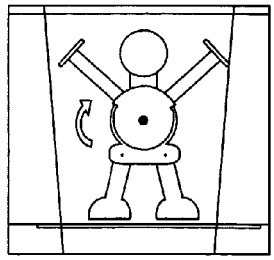
Fig. 9

CARTWHEELING CHARACTER

BACKGROUND OF THE INVENTION

Toy animals and dolls are very popular playthings for small children. Currently, there are many types of animals and dolls on the market that are capable of various types of motions and accompanying sounds. These include toys that sit, stand, roll over, speak, cry, and sing that respond to the actuation of various switch means located at different parts of the toy body. While many of these toys currently exist there is a continual need for new and novel arrangements that will add to the child's pleasure when playing with same.

SUMMARY OF THE INVENTION

There is herein illustrated and described a toy animal that is designed to do one or more cartwheels to either side and also do a headstand. The toy responds through the action of a program controller when a switch in its ear is pressed or hears a sound. The toy also knows when he has fallen down or when he is on his feet.

The subject toy is designed to function in one mode when it is located in its package and in another mode when it has been-removed from its package and is free standing. When it is located in its package a potential customer can operate the toy and see how it moves thus getting a general idea of how it will operate when it is removed from its package. This so-called "try-me" feature is very important in obtaining the child's interest in owning and playing with the toy. When in the package and actuated it will sway side-to-side and then proceed to a headstand. It will then return to an upstanding position in the package. The floor of the package on which the animal is located is spring-loaded to allow the toy to be rotated within the package by having the floor move out of the way of the rotating package while at the same time keeping the toy in touch with the floor.

When the toy animal is taken out of the package and actuated the toy will sway side-to-side and then proceed into either a headstand or a cartwheel. Various mechanisms are employed to move the torso and associated head and arms into a bent position after which inertia causes the toy to fall over onto its hand and head. This becomes a stable position so the toy can then lift its legs and sway them without falling over. As will be described hereinafter the toy is designed (when desired) to do multiple cartwheels and ultimately end in an upright position.

The operation of the various mechanisms to obtain the desired result will be apparent from the following drawings and the descriptions thereof.

BRIEF DESCRIPTION OF THE DRAWINGS

FIG. 6 is a front sectional view showing the tiger in its normal upright position and schematically illustrating the main motor gear box for operating the toy.

FIGS. 7*a*-7*h* shows the various movements of the toy tiger free of its packaging;

FIG. 8 is a view showing the toy tiger mounted in its package; and

FIGS. 9*a*-9*h* show the movement of the toy tiger when actuated by a separate motor while being affixed in position relative to its package;

DETAILED DESCRIPTION

Figure 1:
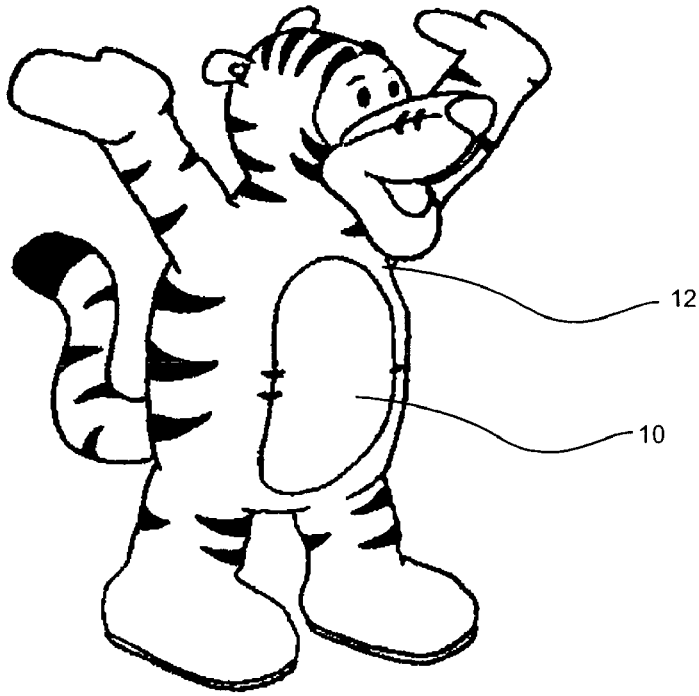
FIG. 1 is a perspective view of a toy figure which in the illustrated embodiment is a toy tiger.
Figure 2:
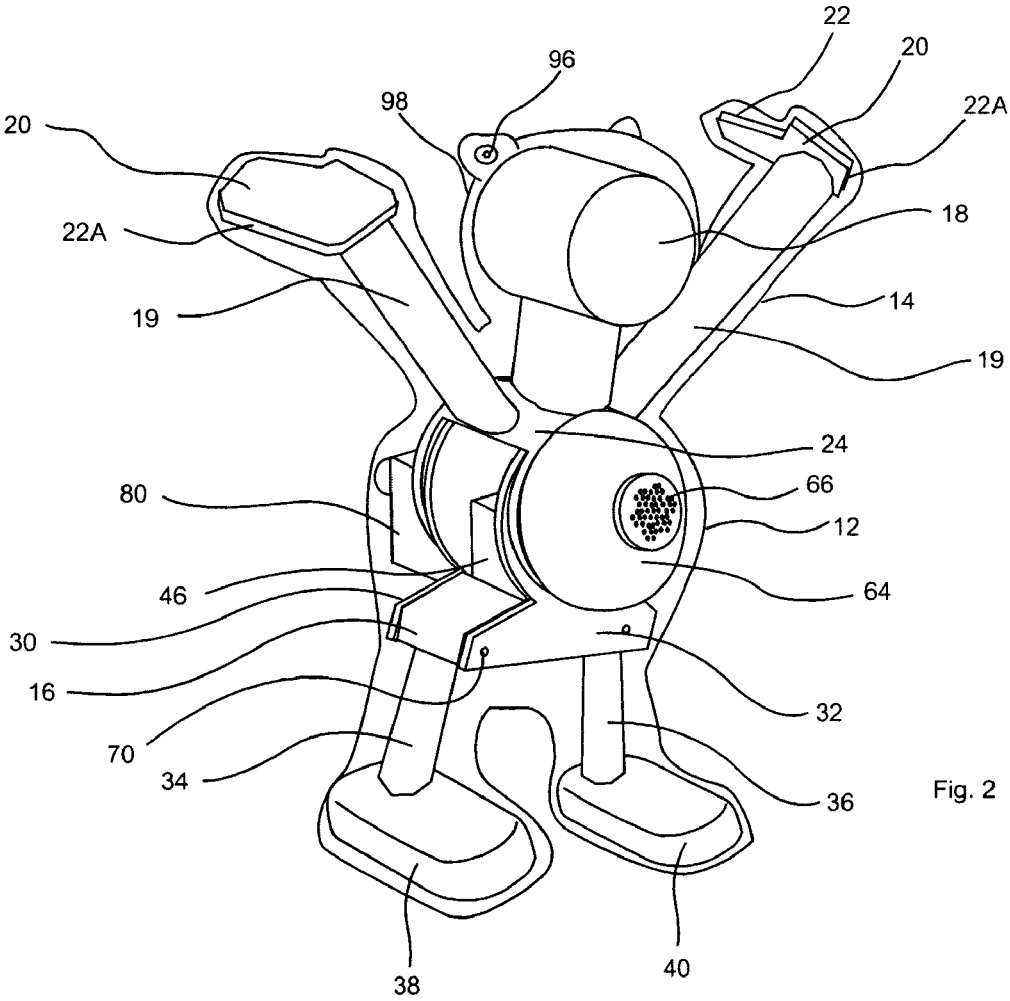
FIG. 2 is a view similar to FIG. 1 with the skin shown in outline only and illustrating the internal operating components of the toy tiger.
Figure 3:
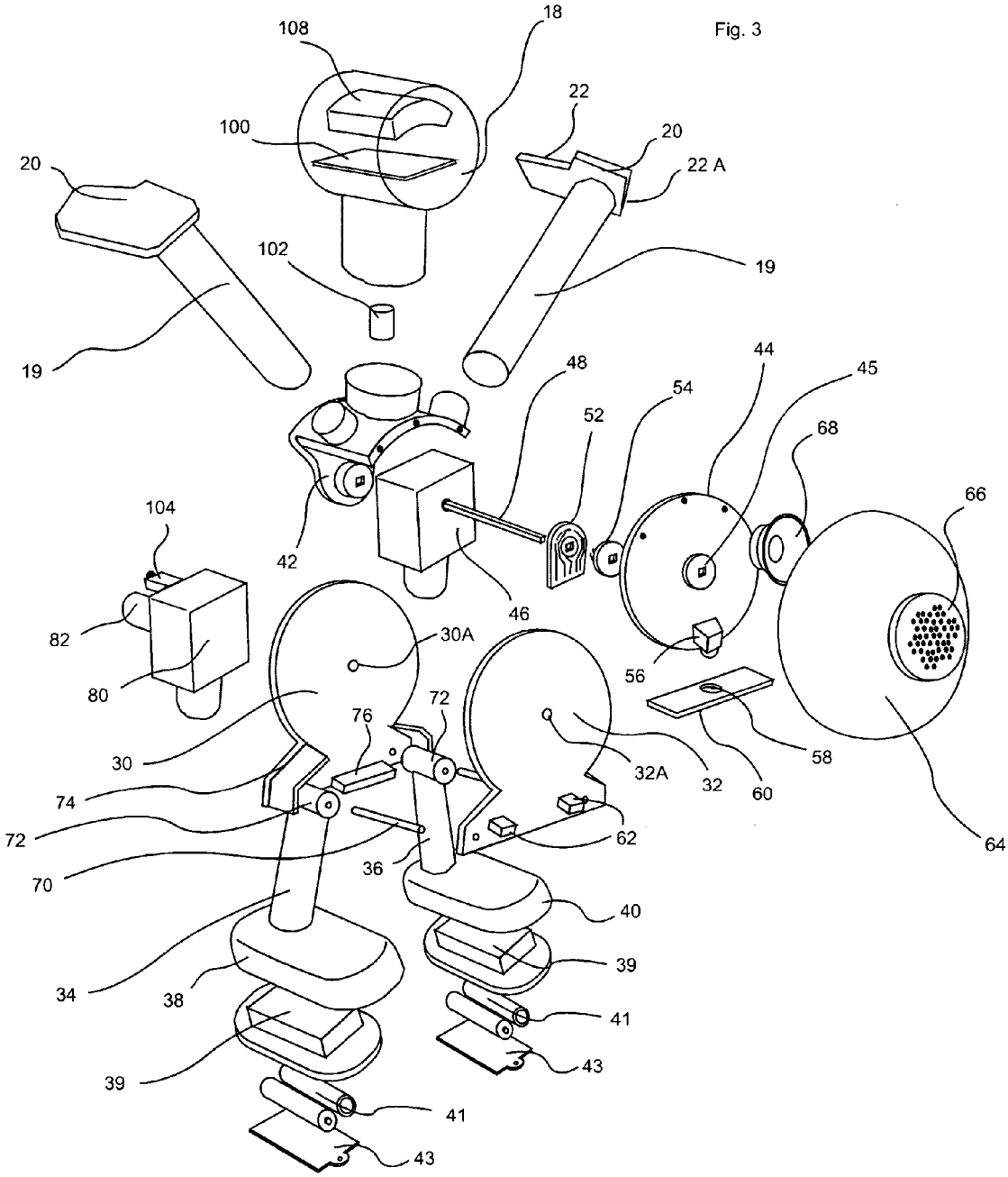
FIG. 3 is a view similar to FIG. 2 with the various components shown in an exploded configuration.
Figure 4:
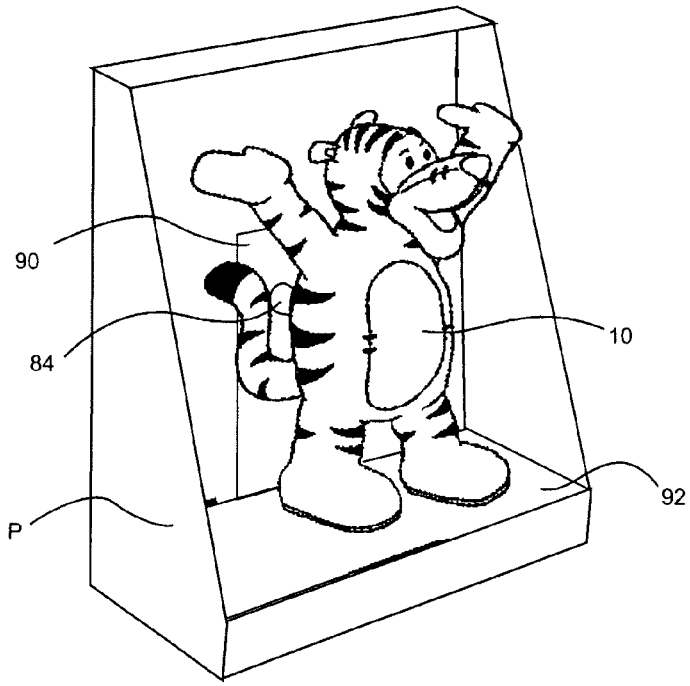
FIG. 4 is a view showing the toy tiger mounted in a package.
Figure 10:
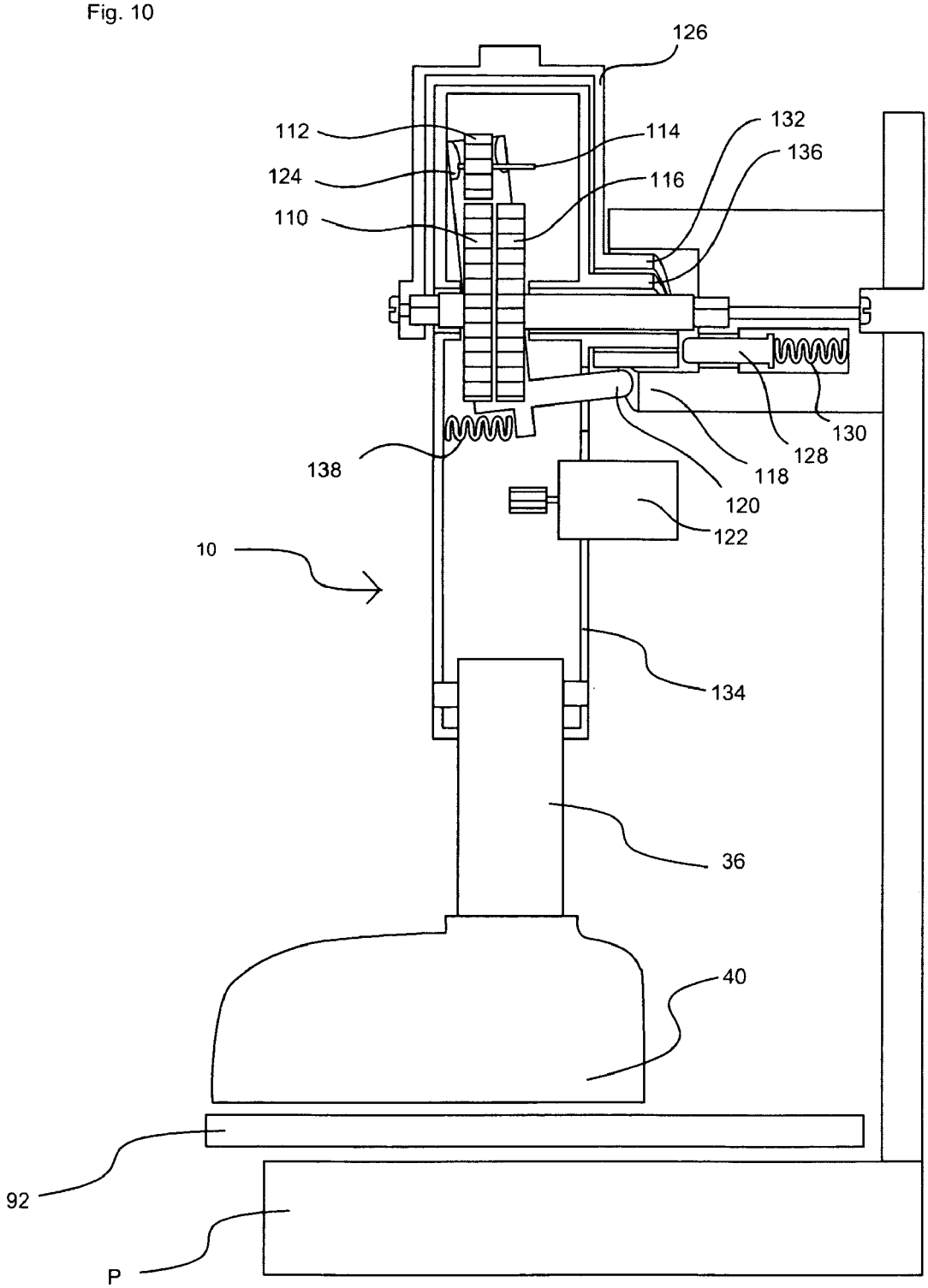
FIG. 10 is a cross-sectional view showing the toy figure affixed in a package in an upright position, which figure uses a single motor for operating the figure while in the package and when removed therefrom.

Referring now to the drawings FIG. 1 illustrates a toy FIG. 10 in its plush skin 12 which covers the various structural and operating of components that are shown in detail in FIGS. 2 and 3.

To facilitate a full understanding of the subject invention the following description will set forth the various components and their functions. Following this description the operation of the novel toy figure assembly will be set forth showing how the novel toy figure assembly functions in the free standing mode and when it is secured in its package.

The internal components include rigid hands, head, legs, and the torso. The torso contains the gearboxes, motors, electronic circuitry, speaker and various other components that will be described in detail hereinafter.

The novel toy figure construction consists of two major assemblies 14, 16, see FIG. 2 that are connected to move relative to each other. The upper assembly 14 consists of a head 18 that is capable of supporting the toy FIG. 10 when in a headstand position, rigid hands 20 in which the palms 22 of the hands 20 have straight edges 22A on its sides which also serve to support the toy FIG. 10 during its cartwheeling and headstanding operation and an upper torso 24. The lower assembly 16 which is movable relative to the upper assembly includes a pair of plates 30, 32 located within the torso 24 and includes depending legs 34, 36 to which feet 38, 40 are attached. The feet 38, 40 include a battery case 39 within which are located AA batteries 41 covered by a plate 43.

Turning again to the upper assembly 14, the head 18 and hands 20 are attached to the rear torso plate 42. The front plate 44 of the torso 24 is connected to the rear torso plate 42 and thus the head 18, arms 19 and torso plates 42, 44 forming the upper assembly move as a unit relative to the plates 30, 32 of the lower assembly 16 that are located between the upper torso plates 42, 44. The upper torso assembly 14 is controlled by a main motor gearbox 46 that is secured to the inner surface of plate 30 of the lower assembly. Extending from the main motor gearbox 46 is a main output shaft 48 that is drivingly connected to the upper torso plates 42, 44, but extends freely through openings 30A, 32A in the lower plates. The main motor gearbox 46 is responsible for the cartwheeling to occur.

To insure that the toy figure knows the position of the toy at all times a swipe switch assembly 50 is provided which consists of a panel control board 52 secured to the main motor gearbox 46 and the swipes 54 that are secured to output shaft 48 to indicate the relative position of the upper assembly 14 to the lower assembly 16. The main output shaft 48 extends loosely through the panel control board 52.

In order to retain the toy in the upright position a releasable detent mechanism is provided by cooperating portions of the upper and lower assemblies consisting of a spring loaded finger 56 attached to the outer surface of plate 44 and an opening 58 in a plate 60 that is suitably secured to projections 62 extending outwardly from the outer surface of plate 32. It is noted that the front cover 64 carries the speaker holder 66 for the speaker 68.

We now refer more specifically to the lower assembly 16 which moves as a unit relative to the upper assembly 14. As aforementioned, the lower assembly includes the two interconnected plates 30, 32 to which the main motor gearbox 46 is connected. The plates 30, 32 are connected by pins 70. The pins 70 extend through openings 72 in leg members 34, 36 and are free to move between flanges 74 extending inwardly from plate 30 and plate 76 also secured to plate 30.

The operation of the upper and lower assemblies 14, 16 relative to each other when in the free standing position will be described in connection with FIGS. 7*a* through 7*h*.

Figure 5:
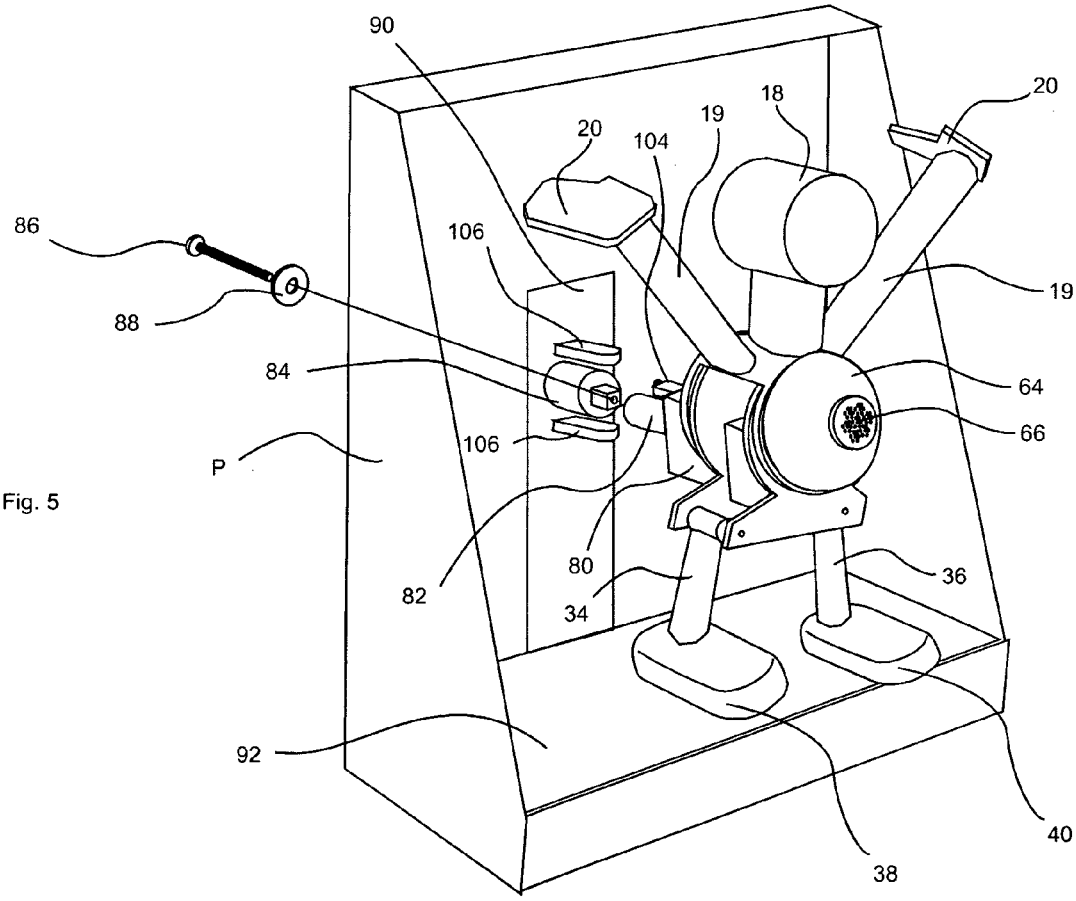
FIG. 5 is a view illustrating the arrangement for securing the tiger to the package.

We now turn to operation of the cartwheel figure when secured in position in its packaging. To this end, reference is made to FIGS. 3 and 5 and the mechanism in question will be referred to as the package motor mechanism.

The package motor mechanism consists of the gearbox 80 and the package output shaft 82. The package output shaft 82 acts as a receptacle for the support shaft 84 in the package P.

This connection is made secure using a screw 86 that travels through a plastic washer 88 all the way from the back of the package and fixes the parts 84 and 82 together. That in turn holds up (suspends) the whole toy 10 when it is in the package P. The support shaft 84 is a rigid member of the support structure of the package that also has a rigid vertical member 90. The package also has a spring-loaded floor 92 that allows toy 10 to turn in the package without getting stuck and also ensuring that the toy appears like it is on the floor rather than floating over it (this is necessary since the toy is suspended from the support structure). The length of the legs 34, 36 from the central pivot point 94 to its extremities is a half inch less than the lengths of the hand extremities to the center pivot point 94. The length to the top of the head 18 from the central pivot point 94 is an inch less than the lengths of the hands 20 and arms 19. This ensures that when the toy goes over its hands it is has the greatest amount of potential energy that gives greater inertia to the cartwheel. A momentary switch 96 is attached to the plush skin 12 in the ear 98. The electronic circuit 100 in the head 18 has a speech and controller that determine how the toy reacts each time the switch is pressed 96. A ball switch 102 located in the head assembly has two positions that it senses that tells the toy when it is standing upright or upside down. A switch 104 on the packaging motor mechanism is activated by fingers 106 on the package support shaft 84. This switch 104 helps the package motor mechanism 80, 82 bring the toy to a position standing straight up or straight upside down in conjunction with the ball switch 102. Dead weights 108 are added to the head to give additional inertia to the torso to help do the cartwheel.

The following sets forth the operation of the tiger when located in the free standing position. Particular reference is made to FIGS. 7*a*-7*h*.

When the tiger is removed from its package it stands upright on his legs 34, 36 and is held in this position using the detent mechanism 56, 60 and then when actuated by switch 96 sways side to side using the main motor mechanism 46 as in FIG. 7*a*. Then the toy figure proceeds into either a headstand or a cartwheel. The process for the headstand is shown in FIGS. 7*b*, 7*c*, and 7*d*. In this process the main gearbox 46 rotates the upper assembly 14 to the left (FIG. 7*b*) and as the upper assembly reaches the end of the travel (when it meets the hip, the inertia of the upper assembly causes the toy 10 to fall over onto the hand 20 and head 18 (FIG. 7*c*). This is a stable position so now the toy through the reaction force of the main motor mechanism 46 can lift the lower assembly 16 with its legs 34, 36 and sway them without falling over (FIG. 7*d*). The body is held in position using the detent mechanism 56, 60. To return to standing position the main gearbox 46 moves the feet to the left (FIG. 7*f*) with full speed, so that when the feet 38, 40 reach the maximum bent position the inertia causes the toy figure to pivot on the hand 20 and brings the legs 34, 36 around to the floor (FIG. 7*g*). The mechanism then proceeds to straighten the torso (FIG. 7*h*). The swipe switch assembly 50 helps to achieve this with great accuracy and the detent mechanism 56, 60 holds the body upright.

To do a cartwheel the main gearbox 46 rotates the upper assembly 14 to the left (FIG. 7*b*) and as the upper assembly reaches the end of the travel (when it meets the hip) the inertia of the upper assembly causes the toy to fall over onto its hand 20 and head 18 (FIG. 7*c*). Then the toy lifts the lower assembly 16 with its legs 34, 36 over to the other side in one complete motion (FIG. 7*e* and 7*f*), the inertia of the legs 34, 36 moving causes the toy figure to pivot on the hand 20 and brings the legs 34, 36 around to the floor (FIG. 7*g*). The slack in the legs (30 degrees slack at the hip joint) helps ensure the toy lands on both legs 34, 36. The mechanism then proceeds to straighten the upper assembly 14 (FIG. 7*h*). If it has to do multiple cartwheels then it is programmed to proceed from the position shown in FIG. 7*g* to FIG. 7*b*, i.e., it rotates the arms all the way from one side to the other without coming to center causing it to fall over as in FIG. 7*c* and then the process continues until it needs to stop when it straightens out.

The following sets forth the operation of the toy figure when it is operated by the action of a program controller while secured in its packaging.

The toy figure stands upright on his legs in its package and is held in this position using the detent mechanism 56, 60 and then sways side to side using the main motor mechanism 46 as in FIG. 9*a*. Then the toy proceeds into a headstand as shown in FIGS. 9*b*, 9*c*, and 9*d*. In this process, the main gearbox 46 rotates the upper assembly 14 to the left (FIG. 9*b*), then the package motor mechanism 80, 82 rotates the whole toy figure unit to the position in FIG. 9*c* where it is resting with its head 18 and hands 20 on the floor 92 of the package. Then the main motor mechanism 46 rotates the feet 38, 40 up to a straight position (FIG. 9*d*). The switch 104 recognizes when it is activated by either fingers 106 in conjunction with the ball switch 102 which in turn tells the toy figure it is straight in the package. The top of the floor 92 of the package is spring-loaded to allow for this rotation by moving out of the way and at the same time keeping the toy figure in touch with the floor. The toy figure then sways in position using the package motor mechanism 80, 82 as in FIG. 9*d*. Then the main motor mechanism 46 moves the feet 38, 40 down from position shown in FIG. 9*e* to position in FIG. 9*f*. Now the package motor mechanism 80, 82 rotates the whole toy figure so that its feet 38, 40 come to rest on the floor 92 (FIG. 9*f* to FIG. 9*g*). Then the main motor mechanism 46 straightens out the upper assembly 14 (FIG. 9*h*). The floor 92 is pushed out of the way during the movements of the package motor mechanism 80, 82.

Figure 11:
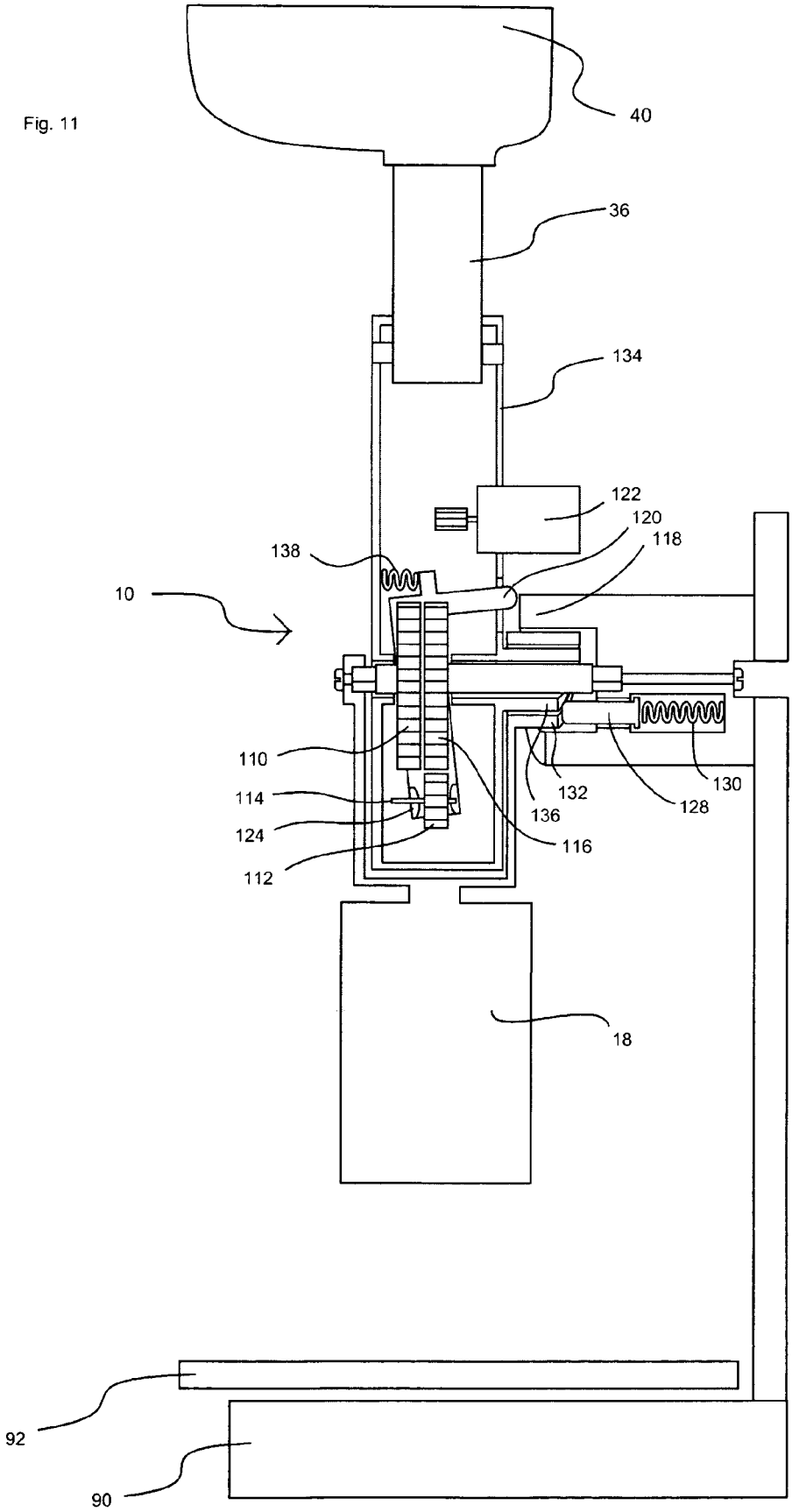
FIG. 11 is a view similar to FIG. 10 with the figure in the inverted position.
Figure 12:
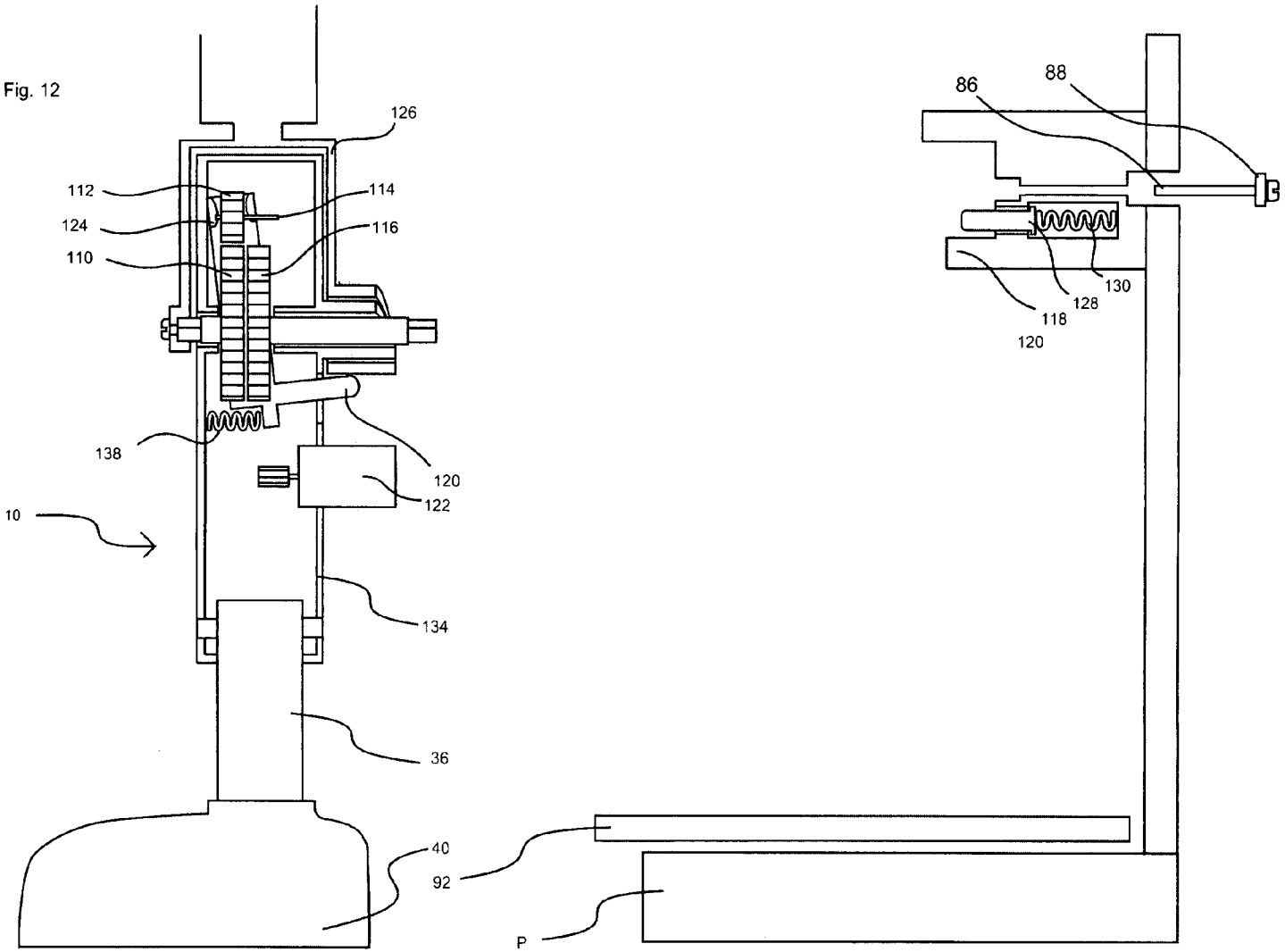
FIG. 12 is a view showing the toy figure of FIGS. 10 and 11 separated from the package.

We now turn to FIGS. 10-12 which is similar in many respects to that shown in FIGS. 1-9 with the major difference being that a single motor is used to both cartwheel the figure when it is secured within its package when it is free of the package.

This is essentially done by a multiple gearing system that is operated by a motor driven shuttle gear. The shuttle gear is positioned by a cam system that moves the shuttle gear between a torso drive gear and a package drive gear. When the figure is in the package the shuttle gear moves back and forth between the torso drive gear and package drive gear to accomplish the desired result. When the figure is out of the package, the shuttle gear remains in contact with the torso drive gear to accomplish the cartwheeling motor discussed in detail with respect to FIGS. 1-9.

The foregoing will be better understood with a description of the details of the single motor system and its method of operation as described hereinafter.

FIG. 10 illustrates a toy FIG. 10 where one motor 122 is used to move the toy figure in normal operation as well as when the toy FIG. 10 is mounted in the package. This is accomplished with a gear shift cam follower 120 working in conjunction with a package cam 118 secured to the package. The toy figure is attached to the rigid vertical member 90 using the package output shaft 82 which is held in place by screw 86 which passes through the rigid vertical member 90. In this position, the gear shift cam follower 120 has its tip resting on the low point of package cam 118. This position the upper portion 124 of gear shift cam follower 120 has positioned the shuttle gear 112 in contact with the torso drive gear 110. Motor 122 through motor gear 123 and suitable gearing (not shown) can move the front torso plate 44 via a square receptacle 45 (see FIG. 3) centrally located in front drive plate 44. The single motor rear torso plate 126 is connected to the front torso plate so that they move in unison. The rear torso plate 126 has a pivotal cam assembly 132 that acts as a portion of an active latch assembly with plunger 128 and spring 130. The cam assembly 132 rotates around passive latch cam 136 which is part of single motor lower plate 134. Passive latch cam 136 works in conjunction with plunger 128 and spring 130.

With the toy FIG. 10 in this position, the motor can move the torso drive gear 110 via the shuttle gear 112 to a position illustrated in FIG. 9*b*. As the upper assembly 14 contacts the lower assembly 16 the gear shift cam follower moves shuttle gear 112 into a position to drive package drive gear 116 to move toy tiger 10 to a position illustrated in FIG. 9*c*. The lower assembly 16 continues to be driven until the toy FIG. 10 is in a position illustrated in FIG. 9*d*. As toy FIG. 10 approaches this position, the gear shift cam follower 120 moves shuttle gear 112 into contact with torso drive gear 110. As toy FIG. 10 moves to the position illustrated in FIG. 9*d* cam assembly 132 works in conjunction with plunger 128 and spring 130 to limit movement of upper assembly 14. The toy figure can now balance on his head and rock back and forth moving the lower assembly 16.

The toy FIG. 10 now moves the lower assembly 16 to the position illustrated in FIG. 9*f*. The passive latch cam 136 now acts on plunger 128 and spring 130 to release cam assembly 132. The gear shift cam follower 120 working in conjunction with package cam 118 now engages shuttle gear 112 with package drive gear 116 to drive the toy figure to the position illustrated in FIG. 9*g*. As toy FIG. 10 approaches the position illustrated in FIG. 9*g*, the package cam moves the gear shift can follower 120 to a position where shuttle gear 112 is engaged with torso drive gear 110. The motor 122 now moves the torso to a position illustrated in FIG. 9*h* and the toy FIG. 10 has completed a cartwheel in the package P.

At various times as the toy FIG. 10 moves through the steps necessary to complete a cartwheel in the package P, passive latch cam 136 working in conjunction with plunger 128 and spring 130 as well as spring loaded floor 92 act to retard the movement of the toy FIG. 10. It should also be noted that an assist spring 138 is used to maintain contact between the tip of gear shift cam follower 120 and the face of package cam 118.

FIG. 11 illustrates the positions of the various gear, cams, springs and followers when the toy figure is in the inverted position.

We now turn to FIG. 12 which shows the use of a single motor 122 is used to move or cartwheel the toy figure in normal operation as well as when the toy figure is located in the package. This figure has many components similar to the toy figure shown in FIG. 5 which uses one motor to operate the figure when it is free of the package and a second motor to operate the toy figure while it is mounted in the package in a "try me" position.

In FIG. 12 the toy is disconnected from but is in close proximity to the packaging. This illustration represents the single motor gear shift option which was illustrated and described with respect to FIG. 10.

The toy figure is held in place in the package P by screw 86 through washer 88 and extends through the package rigid support structure 90. The package rigid support structure contains a square recess, plunger 128 and spring 130 (See FIG. 10). Screw 86 is threaded into a centrally axially located hole in the positive square portion of package drive gear 116 (shown here in an exaggerated length view for clarity). When the toy FIG. 10 is connected to the package the package cam 118 of the package rigid support structure 90 acts upon the gear shift cam follower 120 to shift the position of shuttle gear 112 from driving the package drive gear 116 to the torso drive gear 110 and back to the package drive gear 116. Once the toy FIG. 10 has been removed from the package the package cam 118 no longer acts upon the gear shift cam follower 120. The shuttle gear 112 moves to its normal mode in contact with the torso drive gear 110. The toy figure now operates in a manner similar to that described in FIGS. 7*a*-7*h*.

It is intended to cover by the following claims all modifications and embodiments that come within the true spirit and scope of the invention.

The invention claimed is:

1. A cartwheeling toy having an upper assembly including a torso assembly, rigid arms and hands and a head extending from the torso and a lower assembly including depending legs pivotally connected to the upper assembly, motor operated means connected to said lower assembly for moving said assemblies relative to each other, program controller means responsive to voice or switch actuation for regulating the operation of said motor means, the distance from the pivotal connection to the exterior of the hands being greater than the distance from the pivotal connection to the end of said legs which is greater than the distance from the pivotal connection to the top of the head whereby when the motor means is regulated by the program controller to rotate the upper assembly relative to the lower assembly, the toy will be moved into a headstand and then returned to its upright position or operated to cartwheel the toy as desired.

2. A cartwheeling toy as set forth in claim 1 in which the upper and lower assemblies include cooperating detent means to normally retain the toy in an upright position.

3. A cartwheeling toy as set forth in claim 2 in which the cooperating detent means includes a spring loaded finger and the lower assembly includes a detent plate for retaining the finger when the toy is in the upright position.

4. A cartwheeling toy as set forth in claim 2 in which the upper and lower assemblies include an interactive swipe switch means that interacts with the program controller to define the position of the pivotally connected assemblies at all times.

5. A cartwheeling toy as set forth in claim 1 in which the torso assembly consists of a front and back plate and the lower assembly includes two spaced interconnected plates disposed between the front and back plates of said torso assembly and the motor means is attached to one of said interconnected plates and the motor means includes a drive shaft that is drivingly connected to said torso plates to move the upper and lower assemblies relative to each other.

6. A cartwheeling toy as set forth in claim 5 in which the interconnected plates includes pin means which extend through openings defined by said legs about which said legs can freely pivot, one of said interconnected plates defining abutment means that limit the pivotal movement of said legs.

7. A cartwheeling toy as set forth in claim 1 including a front cover that includes a speaker holder and a speaker that is programmed to be actuated in response to a sound.

8. A cartwheeling toy in accordance with claim 6 in which the head portion includes an added weight to facilitate the rotating effect of the upper assembly when the toy is activated.

9. A packaging assembly for a rotating toy whereby the toy can be rotated in place relative to the package while the toy is affixed to said package to provide a try-me feature for said toy comprising means for pivotally securing a toy relative to said package, said toy comprising an upper assembly and a lower assembly, said upper assembly including a torso assembly, rigid arms and hands and a head extending therefrom, and the lower assembly including depending legs pivotally connected to the upper assembly, first motor means for moving said assemblies relative to each other, the distance from the pivotal connection to the exterior of the hands being greater than the distance from the pivotal connection to the end of said legs which is greater than the distance from the pivotal connection to the top of the head, said package including a resilient support for said toy in the package and second motor means for complete rotating said toy relative to said package which is permitted by said resilient support and a program controller for regulating the action of said first and second motor means to effect the rotating action of said toy in place in the package.

10. A packaging assembly for a rotating toy a set forth in claim 9 in which the second motor means is secured to said torso assembly, and switch means are provided to indicate when the toy is located upright in its package.

11. A package assembly for a rotating toy figure whereby the toy figure can be rotated in placed relative to the package while the toy figure is affixed to said package to provide a try-me feature for said toy figure comprising means for rotatably securing the toy figure relative to said package, said toy figure comprising an upper assembly and a lower assembly, said upper assembly including a torso assembly, rigid arms and hands and a head extending therefrom, and the lower assembly including depending legs pivotally connected to the upper assembly, motor means and first gear means for moving said assemblies relative to each other, the distance from the pivotal connection to the exterior of the hands being greater than the distance from the pivotal connection to the end of said legs which is greater than the distance from the pivotal connection to the top of the head, second gear means for connecting said motor means to rotate said toy figure while mounted in said package and interactive cam and shiftable third gear means for interconnection said motor and said first and second gear means to rotate the toy figure while mounted in said package and said first gear means to rotate said toy figure independent of said package.

12. A package assembly as set forth in claim 11 in which the package includes a resilient floor for retarding the toy figure during the rotating movement.

13. A package assembly as set forth in claim 12 in which the shiftable gear means is controlled by a cam follower riding on a stationary cam secured to said package.

14. A package assembly as set forth in claim 13 in which the cam follower is resiliently biased into position against said stationary cam whereby the third gear means will be moved between said first and second gear means as the toy figure is rotated while affixed to the package.

15. A package assembly as set forth in claim 14 in which the stationary cam works in conjunction with a plunger and spring assembly and resilient floor to act to retard the movement of the toy figure.

* * * * *